US005845621A

United States Patent [19]

Robinson et al.

[11] Patent Number: 5,845,621

[45] Date of Patent: Dec. 8, 1998

[54] BELLOWS PRESSURE PULSATION DAMPER

[75] Inventors: Barry Robinson; Jan Bennett, both of Williamsburg; Jason Kilgore, Newport News, all of Va.

[73] Assignee: Siemens Automotive Corporation, Auburn Hills, Mich.

[21] Appl. No.: 878,971

[22] Filed: Jun. 19, 1997

[51] Int. Cl.[6] ..... F02M 41/00; F02M 55/02

[52] U.S. Cl. ..... 123/456; 123/467; 123/468

[58] Field of Search ..... 123/456, 467, 123/468, 469, 470; 138/26, 30

[56] References Cited

U.S. PATENT DOCUMENTS

| | | | |
|---|---|---|---|
| 4,324,276 | 4/1982 | Kemner . | |
| 4,660,524 | 4/1987 | Bertsch et al. . | |
| 4,729,360 | 3/1988 | Fehrenbach et al. | 123/467 |
| 4,805,575 | 2/1989 | De Concini et al. | 123/468 |
| 5,197,436 | 3/1993 | Ozawa . | |
| 5,284,120 | 2/1994 | Fukushima et al. | 123/510 |
| 5,373,824 | 12/1994 | Peters et al. | 123/456 |
| 5,374,169 | 12/1994 | Talaski | 138/26 |
| 5,411,376 | 5/1995 | Fournier et al. . | |
| 5,413,468 | 5/1995 | Tuckey . | |
| 5,505,181 | 4/1996 | McRae et al. . | |
| 5,516,266 | 5/1996 | Talaski . | |
| 5,598,823 | 2/1997 | Povinger . | |
| 5,617,827 | 4/1997 | Eshleman et al. . | |

*Primary Examiner*—Thomas N. Moulis

[57] ABSTRACT

A fluid communication device such as a fuel rail having a bellows damper positioned either in the end of the fuel rail or orthogonal to the axis of the fuel rail for dampening pulsed pressure waves from the flowing of the fuel. The bellows is a hollow tubular member having an enclosed end with a plurality of circular hollow ribs forming the outer surface of the bellows. The damper may also be located in a pocket or may be free floating in the fuel rail. An additional spring member is added to the damper for changing the spring rate characteristic of the bellows.

12 Claims, 2 Drawing Sheets

BELLOWS PRESSURE PULSATION DAMPER

FIELD OF THE INVENTION

This invention relates to pressure dampers for use in fuel injection systems in fuel delivery systems for engines for motor vehicles.

BACKGROUND OF THE INVENTION

In fuel rails for injector-based fuel injection systems, the various devices associated with the fuel system cause pressure waves in the fuel to propagate through the fuel rails. Such pressure waves, if occurring at the wrong time, may have a small amount of fuel leaving the fuel rail and being injected into the engine at the time the injector is pulsed open. In addition such pressure waves cause noise in the system that may be objectionable. Pressure pulses will give false readings to fuel pressure regulators by operating the regulator with a false indication of fuel pressure which may result in fuel being bypassed and returned to the fuel tank.

Prior art pressure dampers such as U.S. Pat. No. 4,660,524 issued on Apr. 28, 1987 teach the use of elastic walls forming the fuel supply line. As pressure pulses occur, the elastic walls function to dampen the pressure pulsations. U.S. Pat. No. 5,197,436 issued on Mar. 30, 1993, illustrates the use of a pressure damper plugged in the end of a fuel rail with a pressure regulator at the other end. U.S. Pat. No. 5,617,827 issued Apr. 8, 1997, illustrates a fuel rail damper which is a compliant member operable to reduce peak pressure during injector firing events. The damper is positioned in the fuel rail so as to not adversely affect the flow of fuel to an injector opening in the rail. The damper is not free to rotate in the rail and the pressure pulses are dampen by the damper which is a pair of welded together shell halves with an enclosed airspace. U.S. Pat. No. 5,598,823 issued Feb. 4, 1997, teaches an in-line fuel pressure damper from the outlet of the fuel filter to the fuel rail. The damper is a pressure accumulator which operative to reduce transient pressure fluctuations induced by the fuel pump and the opening and closing of the fuel injectors.

U.S. Pat. No. 5,505,181 issued on Apr. 9, 1996, and assigned to a common assignee, teaches an integral pressure damper that is easily attached to the fuel rail. The return tube is brazed to the rail and then at a convenient time in the assembly process the damper which is a diaphragm, is attached to the return tube and crimped into position. The diaphragm operates to reduce audible operating noise produced by the injector pressure pulsations.

U.S. Pat. Nos. 5,516,266 issued May 14, 1996, and 5,413,468 issued May 9, 1995, teach the use of a pulse damper in the fuel pump comprising a hollow body formed of a thin walled tube of flexible and resilient plastic material with heat sealed ends forming at least one chamber. The chamber carries a compressible gas to dampen pressure pulsations. U.S. Pat. No. 5,411,376 issued on May 2, 1995, also teaches the use of a bellows modulator inside a gear rotor fuel pump for reducing pump noise by reducing the amplitude of fuel pressure pulses.

U.S. Pat. No. 4,324,276 issued on Apr. 13, 1982, teaches the use of a bellows-like device at the junction of the lines of the flow path of the fluid from a fuel feed pump thereby forming a discontinuity in the flow path to reduce compressional vibrations of fuel being conveyed.

SUMMARY OF THE INVENTION

A fuel pressure damper is installed in the fuel injection system preferably in the fuel rail and operates to reduce the fuel pressure pulsations which are created primarily by the injector opening and closing. The damper has a bellows that responds to the pulsations and operates to contract or expand depending on the magnitude and direction of the pulse. The bellows encloses a chamber which is sealed and may contain an inert gas or atmospheric air at any desired pressure. The bellows typically contracts in the presence of a pulse and then expands when the pulse pressure is less than the enclosed fluid or gas.

In another embodiment, the enclosed chamber contains a preloaded spring member which functions to provide a higher pressure threshold to the contraction of the bellows. In still another embodiment, the damper is fabricated to float in the rail and to absorb the pressure pulses.

These and other embodiments will become apparent from the followed detailed drawings and detailed description.

DETAILED DESCRIPTION

Figure 1:
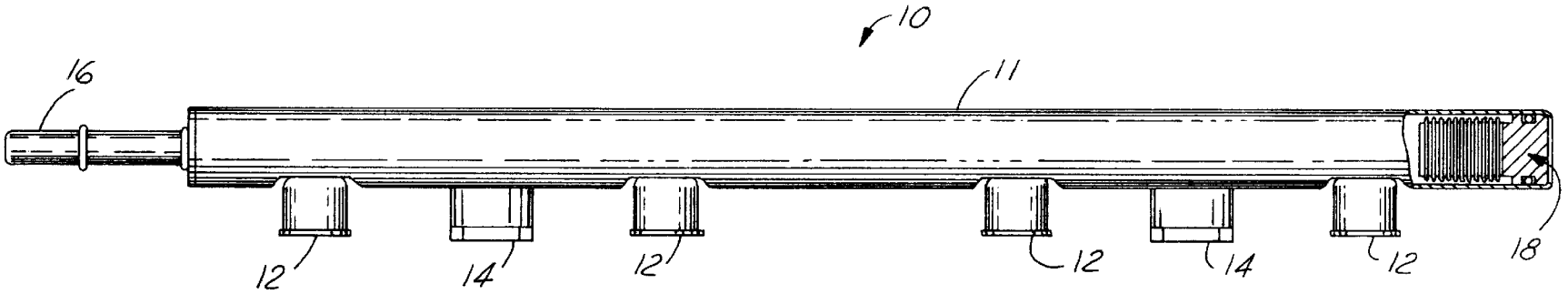
FIG. 1 is a plan view of a fuel rail with one end broken away illustrating the damper of the preferred embodiment.

Referring to the Figs. by the reference characters wherein like elements have the same the reference character in each embodiment and more particularly to FIG. 1, there is illustrated a fluid communication device 10 such as a fuel rail 11 as may be found in the fuel management system of a motor vehicle. In an integrated air-fuel module, the fluid communication device is a passageway or passageways for either or both a liquid such as gasoline or a non-liquid fluid, such as air. This particular fuel rail 11 has four injector cups 12 for receiving four fuel injectors, not shown. In addition, there is illustrated a pair of brackets 14 for mounting the fuel rail 11 to an engine which is not shown. At one end of the fuel rail 11 there is a fuel inlet 16 which is connected through several members, not shown, to a source of fuel. At the other end of the fuel rail, there is illustrated a damper 18 according to a preferred embodiment of the invention. The damper 18, in FIG. 1, functions both to seal the end of the fuel rail 11 and to dampen or suppress fuel pressure pulsations or a standing wave pressure pulse.

Figure 2:
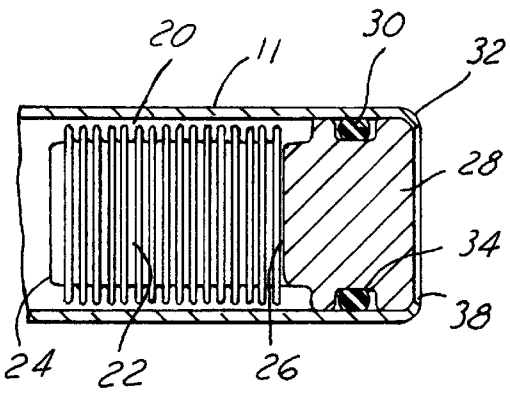
FIG. 2 is an enlarged sectional view of the damper of FIG. 1.

Referring to FIG. 2, there is illustrated the damper 18 of FIG. 1. The damper is a member having a bellows 20 which is formed from a hollow tube 22 having an enclosed end 24. The bellows 20 maybe formed of stainless steel, Inconel, electrodeposited nickel, to name but a few of the materials that may be used. Each material must be able to withstand the various fluids or fuels that are in the system. At the open end 26 of the tube 22, the tube is mounted to a plug member 28 in a manner to prevent any fluid leakage from inside the bellows 20. The hollow tube 22 may have any suitable fluid contained therein at any desired pressure from a vacuum to a positive pressure. The plug member 28 has an O-ring sealing member 30 or the plug member may be laser welded to the tube 22 forming a seal. The end of the plug member 28 opposite the bellows end is secured in the fuel rail 11. The plug member has an outside diameter which is sized to slide in the fuel rail 10 with the O-ring seal 30 bearing against the inside wall of the fuel rail 11 to prevent any flow of fuel past the plug member. Once the plug member 28 and O-ring seal 30 are inserted in the fuel rail 11, the end 32 of the fuel rail is crimped over to retain the damper 18.

The bellows 22 may be fabricated by rolling, hydroforming, welding or chemical deposition. Many uses of bellows are found in motor vehicles such as in aneroids to compensate for altitude; in connecting flexible shafts together; in areas for transmitting axial or angular motion from one shaft to another; providing discontinuities in the fluid path to name but a few applications. The use of bellows as a damper however, has not found in fuel injection systems. In the present application, the bellows' wall is very thin hence very sensitive to pulsed pressure signals. The function of the bellows 22 is to received pulsed fuel pressure signals and by compressing or when in tension by stretching, to smooth out the pressure peaks so as to provide a relatively laminar flow of the fuel or fluid in the fuel rail 11 or fluid communication device 10 and into each injector as the respective injector is opened. The bellows 22, having its hollow ribs forming the discontinuous wall of the hollow tube 20, provides the resiliency necessary to absorb the pressure pulses. The pressure pulses acting on the plurality of the hollow ribs of the bellows 22 operates to compress or stretch the bellows thereby absorbing the pulsed pressure. The bellows may be in either a compression mode or in a tension mode as illustrated, for instance in either FIG. 5 or 8 respectively.

The damper 18 has a plug member 28 is secured to the bellows 22 by means such as a 360° laser weld or by chemical bonding for a leak-proof connection. The plug member 28 has an O-ring pocket 34 to locate and secure the O-ring 30 from axial movement. The major outside diameter of the plug member 28, as previously indicated is a very close fit to the inside diameter of the fuel rail 11 so that the plug member with the O-ring 30 functions to retain the damper 18 in the position which it is initially placed. Once the plug member is in position the end of the fuel rail 11, the fuel rail 11 is crimped 36 or folded over 38 providing a fixed stop with the flange 40 of the plug member 28 of the damper 18.

Figure 3:
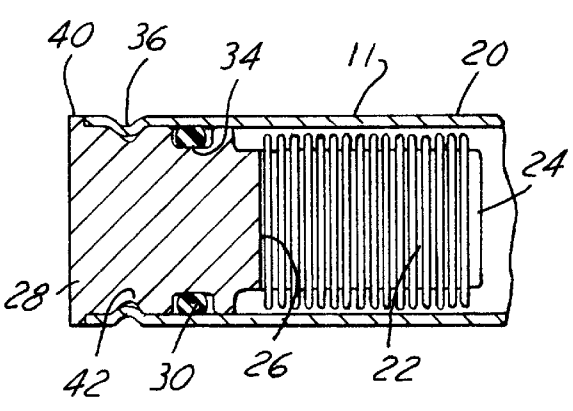
FIG. 3 is another embodiment of the damper of FIG. 1.

Referring to FIG. 3, there is illustrated another embodiment of the damper 18 wherein the plug member 28 is formed to receive a crimping of the fuel rail 11 into a groove 42 in the plug member. In this embodiment, the bellows 22 functions the same as in FIG. 2, but the end of the plug member has a circumferential groove 42 which receives the crimped end of the fuel rail 11.

Figure 4:
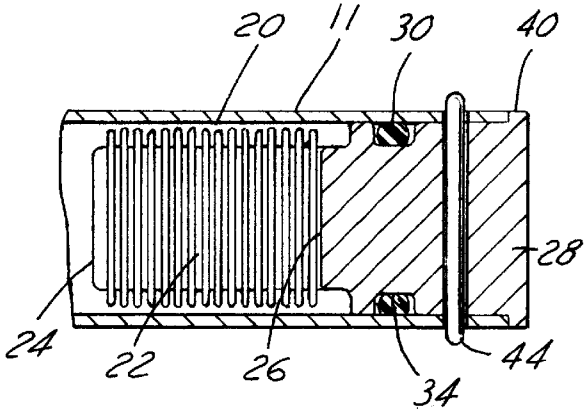
FIG. 4 is still another embodiment of the damper of FIG. 1.

Referring to FIG. 3, the damper is clipped to the end of the fuel rail 11 by means of a clip 44. The fuel rail 11 has a pair of diametrically opposed slots for receiving the clip 44 which is also secured in a circumferential groove in the plug member. Along with the O-ring 30 and the tight fit of the plug member, fuel can not leak from the fuel rail 11. In embodiments of FIGS. 3, 4 and 7, the end of the plug member 28 has a flange 40 that is formed to provide a positive stop to locate the damper 18 in the end of the fuel rail 11.

Figure 5:
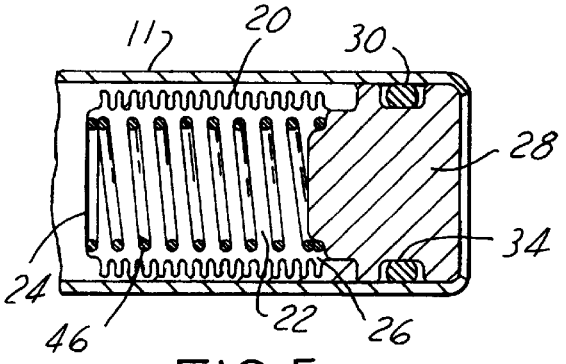
FIG. 5 is another embodiment of the damper of FIG. 1 illustrating an enclosed resilient member.

Referring to FIG. 5, there is illustrated another embodiment of the damper 18 wherein the hollow inter space of the bellows 22 contains a bias member 46 such as a spring member to provide an additional force. In this embodiment, the spring member 46 raises the force level or spring rate of the bellows response. Thus, a higher fuel pressure pulsation is required to actuate the bellows 22. This embodiment is used in higher pressure applications such as in high pressure fuel applications. Without the bias member 46, the required thickness of the walls of the hollow ribs would reduce the effectiveness of the bellows.

Figure 6:
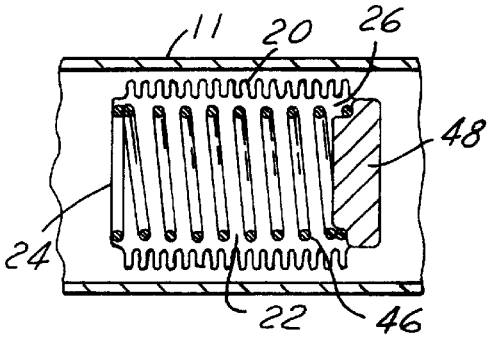
FIG. 6 is another embodiment of the damper.

Referring to FIG. 6, there is illustrated a damper 18 which is a floating damper. In this particular embodiment there is no O-ring around the plug member 48, as the fuel must flow by. In this particular embodiment there is illustrated an optional bias member 46 located in the hollow tube 22 of the bellows. The open end 26 of the bellows 20 is enclosed by the plug member 48 which also supports the one end of the bias means. The enclosed end 24 of the bellows, opposite the plug member 48, supports the other end of the bias member 46.

In each of the previous embodiments, FIGS. 2–6, the damper 18 is located along the axial length of the fuel rail. This is the most typical application of the damper.

Figure 7:
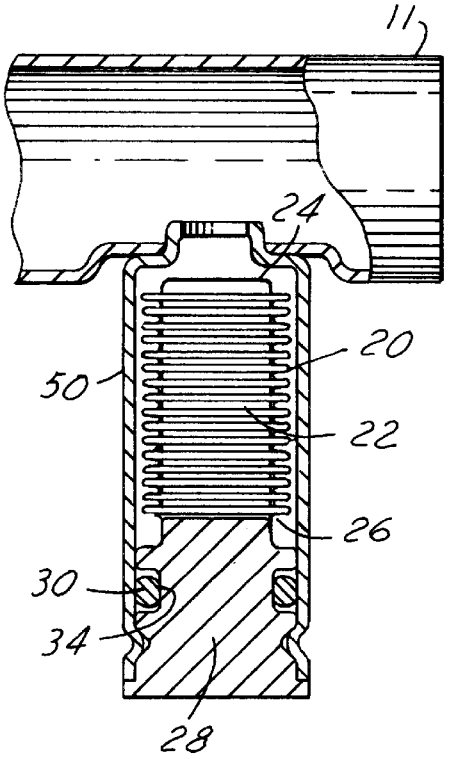
FIG. 7 illustrates the damper mounted to the side wall of the fuel rail.
Figure 8:
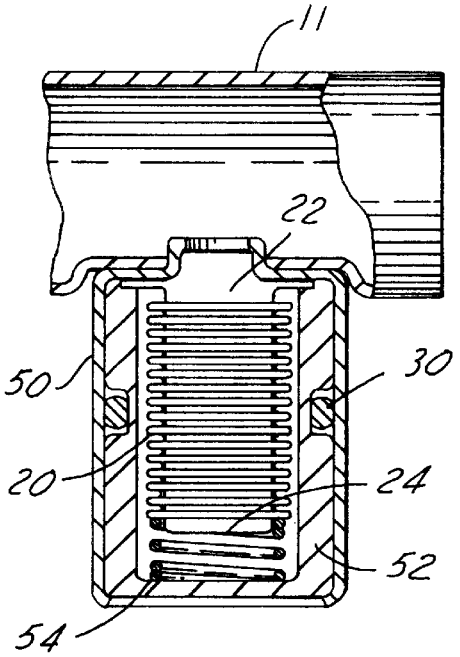
FIG. 8 is another embodiment of the damper of FIG. 7 illustrating an external resilient member.

Referring to FIGS. 7 and 8 the damper is located orthogonal to the axis of the fuel rail 11 and in a cup-like member 50 which is secured to the fuel rail 11 through an aperture in much the same way as the injector cups 12 are secured to the fuel rail. Other than the damper 18 being located orthogonal to the fuel rail, the damper is identical to one of the dampers of the previous Figs.

In FIG. 8, the damper is also located orthogonal to the axis of the fuel rail and the added bias member operates to increase the pressure response of the damper. In this particular embodiment the plug member 52 is a tubular member having an O-ring seal encircling the plug member intermediate its ends, preventing fuel from reaching the outside bottom of the plug member 52. The bias member 54 bears against the bottom of the enclosed end of the plug member 52 and against the bellows 20. The pressure pulses flow into the interior of the hollow tube 22 of the bellows and with the cooperation between the spring force and the hollow ribs of the bellows 20, the pressure pulses are smoothed out.

The use of a bellows damper 18 has been shown in a fluid communication device 10 such as a fuel rail 11, although such a damper may be positioned in other parts of a fuel or fluid systems such as in cooperation with molded passageways. Such other areas are in pressure regulator, fuel pump motors or any place wherein pressure pulses occur.

There has thus been shown, taught and illustrated the use of a bellows member as a pressure damper. This is in contrast to the pressure dampers as shown in the Background of the Invention and more particular the inflated members as found in the fuel rails or in the fuel pump motor. In addition the bellows does not require the diaphragm as found in U.S. Pat. No. 5,505,181.

What is claimed is:

1. A damper for suppressing pulsed pressure signals in fluid communication devices such as a fuel rail in a fuel system for an internal combustion engine, the damper comprises:

a bellows having a plurality of circular thin hollow ribs formed as the outer surface of a hollow tube enclosed at one end;

a plug member secured to said bellows at the open end of said hollow tube forming an integral member, said junction of said plug member and said hollow tube forming a leak proof junction; and a sealing member circumferentially positioned around said plug member, said sealing member located in an circumferential pocket on said plug member.

2. A damper according to claim 1 wherein said hollow ribs and said hollow tube are stainless steel.

3. A damper according to claim 1 wherein said plug member has a crimping groove circumferentially formed on its outer surface.

4. A damper according to claim 1 additionally including a resilient member within said hollow tube, said resilient member bearing against said plug member and the enclosed end of said hollow tube.

5. A damper according to claim 4 wherein said resilient member is a compression spring.

6. A damper according to claim 1 additionally including a resilient member outside of said hollow tube and bearing against said enclosed end of said hollow tube and said plug member.

7. A damper according to claim 6 wherein said resilient member is a compression spring.

8. A damper for suppressing pulsed pressure signals in fluid communication devices such as a fuel rail in a fuel system for an internal combustion engine, the damper comprises:

a bellows having a plurality of circular thin hollow ribs forming the outer surface of a hollow tube enclosed at one end; and a plug member secured to said bellows at the open end of the hollow tube forming an integral member, said plug member being secured to said hollow tube in a fluid leak-proof manner.

9. A damper according to claim 8 additionally including a resilient member located within said hollow tube and bearing against said enclosed end of said hollow tube and said plug member.

10. A damper according to claim 9 wherein said resilient member is a compression spring.

11. A damper according to claim 8 additionally including a sealing member circumferentially positioned around said plug member, said sealing member located in an circumferential pocket on said plug member.

12. A damper according to claim 8 additionally including a laser weld for locating and sealing said plug member to the fluid communication device.

* * * * *